313-422 SR
1/1/80 OR 4,181,871

United States Patent [19]
Gange

[11] 4,181,871
[45] Jan. 1, 1980

[54] PROXIMITY FOCUSED ELECTRON BEAM GUIDE DISPLAY DEVICE INCLUDING MESH HAVING APERTURES NO GREATER THAN 26 MICRONS IN ONE DIMENSION

[75] Inventor: Robert A. Gange, Belle Mead, N.J.

[73] Assignee: RCA Corporation, New York, N.Y.

[21] Appl. No.: 861,454

[22] Filed: Dec. 16, 1977

[51] Int. Cl.[2] ..... H01J 29/08; H01J 29/72; H01J 29/56

[52] U.S. Cl. ..... 313/422; 313/458

[58] Field of Search ..... 313/422, 400; 315/366

[56] References Cited

U.S. PATENT DOCUMENTS 4,069,439 1/1978 Anderson ..... 313/422

*Primary Examiner*—Robert Segal

*Attorney, Agent, or Firm*—Eugene M. Whitacre; George E. Haas; Vincent J. Coughlin, Jr.

[57] ABSTRACT

The envelope of an image display device has front and rear walls spaced from one another with a cathodoluminescent screen on the front wall. Within the envelope are a plurality of electron beam guides parallel to the rear wall and a source of electrons at one end of the beam guide. Each beam guide has at least one electrode adjacent to and parallel to the rear wall. A plurality of spaced parallel wires arranged in a common plane are between the electrode and the front wall. An electrically conductive mesh is parallel to the plane of wires between the plane and the front wall. The mesh has a plurality of closely spaced apertures which are not greater than 26 microns wide in one dimension.

9 Claims, 7 Drawing Figures

PROXIMITY FOCUSED ELECTRON BEAM GUIDE DISPLAY DEVICE INCLUDING MESH HAVING APERTURES NO GREATER THAN 26 MICRONS IN ONE DIMENSION

BACKGROUND OF THE INVENTION

The present invention relates to panel type image display devices and more particularly to such devices having a unique electron beam guide allowing proximity focusing of the electron beam.

Recently, one type of large area image display device has been suggested utilizing an envelope between 25 and 76 mm thick and having a screen size of approximately 76 cm. × 102 cm. The display device has a plurality of electron beam guides within the envelope to guide the electron beams to various positions on a cathodoluminescent screen. Such a device is disclosed in U.S. Pat. No. 4,031,427 issued on June 21, 1977 to T. O. Stanley and entitled "Flat Cathode Ray Tube". One type of electron beam guide used in such a display device is commonly referred to as a slalom beam guide because the electron beam undulates above and below a plurality of coplanar wires as it travels down the guide. This type of guide is described in U.S. patent application Ser. No. 607,490, entitled "Flat Display Device With Beam Guide", filed on Aug. 25, 1975 by T. L. Credelle, now U.S. Pat. No. 4,103,204, issued July 25, 1978. One of the important concepts in the slalom guide is that the electrical fields within the guide itself are balanced in the front and rear directions so that the electron beam will not be attracted toward either the front or rear panel as it travels through the guide. As a result, the screen has been spaced a relatively large distance, e.g., 25 mm., from the guide so that the field strength, (volts/mm.) on the screen side of the guide is not so strong as to unbalance the otherwise symmetrical fields within the guide. Since the electrons travel through this relatively large distance on their way to the screen, excessive spreading of the beam has resulted which has reduced the image resolution and adversely affected color purity. To prevent excessive angular beam spreading, focusing electrodes may be incorporated between the guide and the screen; however, these additional electrodes complicate manufacturing processes and require additional bias voltages.

SUMMARY

An image display device has an envelope with spaced front and rear walls. A cathodoluminescent screen is on the front wall. A plurality of electron beam guides are parallel to the rear wall with an electron beam source at one end of the guides. At least one electrode is adjacent and parallel to the rear wall. An electrically conductive grid is parallel to the electrode between the electrode and the front wall. The grid has a plurality of apertures no greater than 26 microns in one dimension.

DETAILED DESCRIPTION OF THE PREFERRED EMBODIMENT

Figure 1:
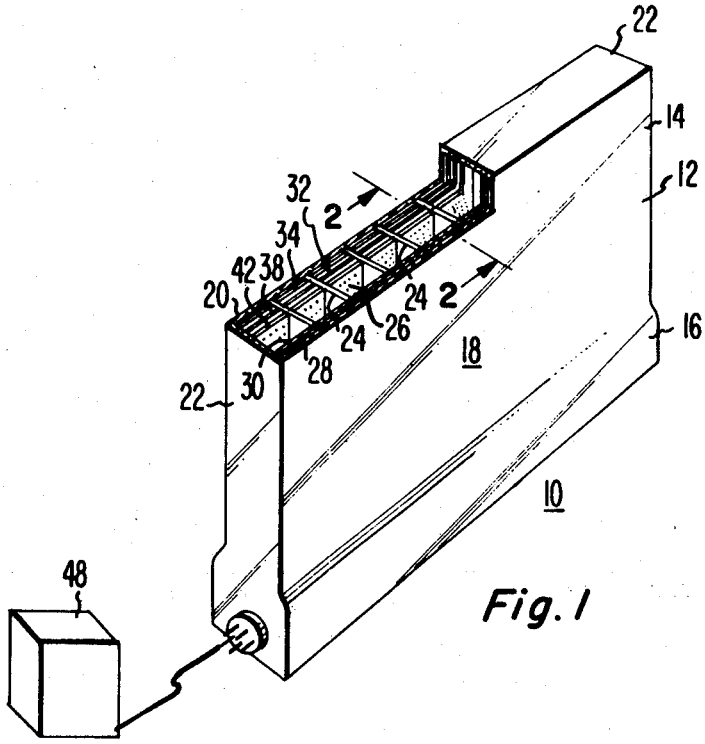
FIG. 1 is a cutaway perspective view of a flat panel display device incorporating the present invention.

With initial reference to FIG. 1, a flat panel image display device 10 includes an envelope 12 divided into a display section 14 and an electron gun section 16. The envelope further comprises a front wall 18 and a rear wall 20 in a parallel relationship spaced apart approximately 0.6 cm by sidewalls 22. Within the envelope 12 are a plurality of support walls 24 extending between the front and rear walls 18 and 20, respectively. The support walls 24 divide the envelope interior into a plurality of channels 26 and provide the internal support for the envelope against external atmospheric pressure. On the interior surface of the front wall 18 is a cathodoluminescent screen 28 having a conductive coating 30 forming an ultor anode.

The gun section 16 is an extension of the display section 14 and extends along one set of adjacent ends of the channels 26. The gun section 16 may be of any shape suitable to enclose the particular gun structure contained therein. The electron gun structure may be of any well-known construction suitable for selectively directing beams of electrons along each of the channels 26. For example, a gun structure may comprise a plurality of individual guns mounted at the ends of the channels 26. Alternately, the gun structure may include a line cathode extending along the gun section 16 across the ends of the channels 26 and adapted to selectively direct individual beams of electrons into the channels. A gun structure of the line type is described in U.S. Pat. No. 2,858,464 entitled "Cathode Ray Tube" issued on Oct. 28, 1958 to W. L. Roberts.

Figure 2:
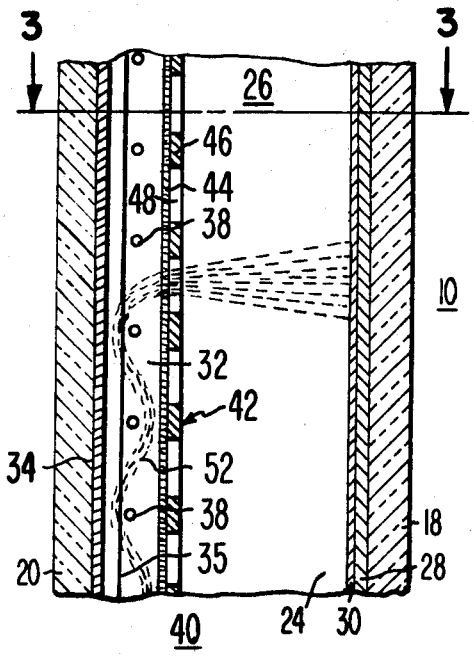
FIG. 2 is a sectional view of a first embodiment of a beam guide taken along line 2—2 of FIG. 1.
Figure 3:
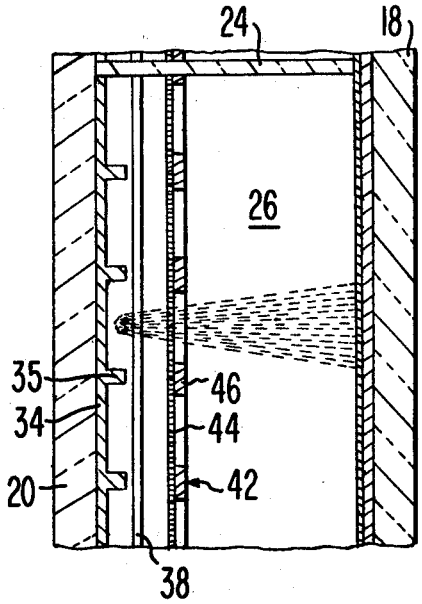
FIG. 3 is a sectional view taken along line 3—3 of FIG. 2.

Located within each channel 26 adjacent to the rear wall 20 are a plurality of electron beam guides 32, formed by an electrode 34, grid wires 38 and a guide grid 42. As shown in FIGS. 2 and 3 in a first embodiment 40, the electrode 34 is an electrically conductive layer on the rear wall 20 with a plurality of protrusions 35 extending therefrom. The protrusions 35 extend longitudinally in the channels 26 and define a beam guide between adjacent protrusions. The grid wires 38 extend transversely across the channels 26 in a common plane between the electrode 34 and the front wall 18. The guide grid 42 is positioned between the plane of wires 38 and the front wall 18 in close proximity to the grid wires. By way of a specific example, the electron beam guide can use wires 38 which are 0.15 mm in diameter and spaced apart a distance of 1.5 mm. The plane of the grid wires 38 can be approximately 0.75 mm. from the surface of the electrodes 34. The grid 42 may be spaced 1.5 mm from the electrodes 34.

The structure of the guide grid 42 is formed by a fine first grid 44 and a coarse second grid 46 which is contiguous with the first grid 44. The coarse second grid 46 has a plurality of apertures 48 which may typically be about 0.16 mm along the channel 26 by 1.35 mm across the channel. The dimensions of the apertures 48 may vary as long as the entire beam may pass through a single aperture upon deflection as will hereinafter be described. The apertures 48 have a periodicity equal to that of the guide wires 38 and are positioned between adjacent wires 38 as shown in FIG. 2. The finer first grid 44 has a plurality of extremely small apertures therethrough. The apertures in the fine grid 44 may take on any of several shapes but should be relatively small in size so that the smallest dimension is less than 26 microns. The grid 44 may have a plurality of round apertures which are less than 26 microns in diameter. While it is preferable that the finer apertures in the first grid 44 be spaced uniformly with respect to one another, their periodicity is not critical to the invention herein. However, it is readily apparent that as the distance between adjacent fine apertures increases, the electron beam transmission through the first grid 44 will decrease. Typically, the apertures in the first grid 44 may be round, having a diameter of 26 microns or less and spaced approximately 13 microns from each other.

The guide grid 42 may be fabricated utilizing electroformed mask technology. In this method, a sheet of metal, such as copper sheet about 76 to 152 microns thick, has a relatively thin (e.g., 1 micron) conductive film such as nickel, for example, applied to one of its major surfaces. Then, utilizing any of several etching techniques, a plurality of holes are sequentially etched in the film and sheet to form the first and second grids 44 and 46, respectively. The resultant guide grid 42 has the relatively coarse second grid 46 acting as a support for a fine membrane-like first grid 44. It should be noted, however, that the present invention is not limited to the particular structure of the guide grid 42 as disclosed in the embodiments herein.

During the operation of the display device, an electron beam 52 generated in the gun section 16 travels up each of the guides undulating about the grid wires 38 as shown in FIG. 2. The protrusions 35 confine the beam 52 from spreading laterally in the guide. The beam 52 is then extracted from the guide at various positions along the guide's length by biasing one of the wires 38*a* to repel the beam out of the guide toward the screen 28. A more detailed explanation of the functioning of the beam guide is contained in the previously cited copending U.S. patent application Ser. No. 607,490, now U.S. Pat. No. 4,103,204, issued July 25, 1978. As the beam 52 is extracted from the guide, it passes through a plurality of the smaller apertures in the finer first grid 44 and through one of the apertures 48 in the coarse second grid 46.

The fine mesh guide grid 42 balances the electrical fields within the guide 32 so that the electric field on the screen side of the grid wires 38 equals the electric field on the rear wall side. The guide grid 42 enables the guide to screen distance to be decreased to reduce beam spread and eliminate the necessity for additional focusing meshes without disturbing the symmetry of the fields within the guide. This reduction in spacing would not be possible in conventional single guide grid devices having one large aperture through which the entire beam passes upon extraction from the guide. The apertures should be no greater than 26 microns in at least one dimension so that the high ultor electric field will not be able to penetrate the guide grid. The apertures should be closely spaced so as to permit maximum electron transmission while maintaining the structural integrity of the grid. It should also be noted that the larger aperture 48 in the second grid 46 may be larger than those shown in FIGS. 2 and 3. For example, one opening may actually permit the beams from two separate extraction points of the guide 32 to pass through.

Figure 4:
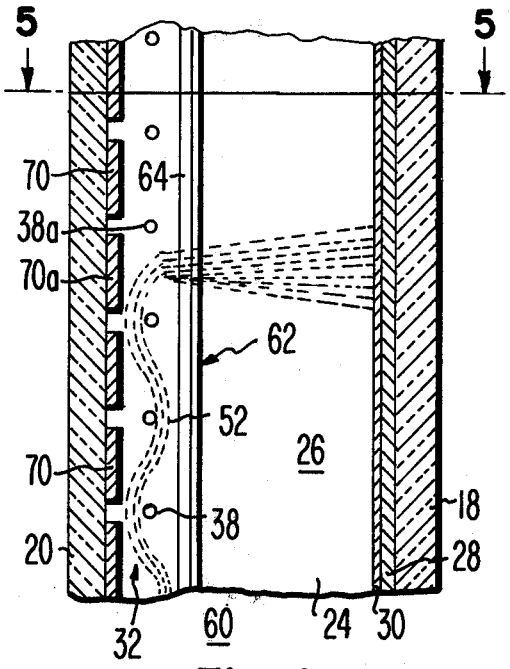
FIG. 4 is a sectional view similar to that of FIG. 2 of a modification of the beam guide of FIG. 2.
Figure 5:
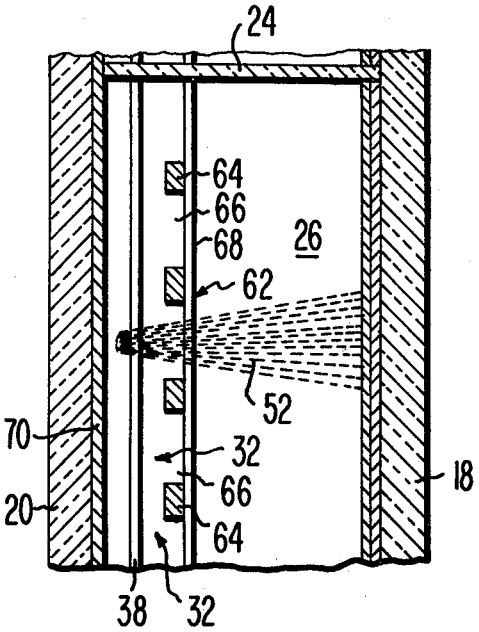
FIG. 5 is a sectional view taken along line 5—5 of FIG. 4.

With reference to FIGS. 4 and 5, a second embodiment 60 of the electron beam guide may utilize a slit guide grid 62. The slit guide grid 62 comprises a plurality of electrically conductive strips 64 extending longitudinally in each channel 26 so as to form a plurality of slit apertures 66 therebetween. Contiguous with the strips 64 on the screen side thereof is a fine grid 68 similar to the fine first grid 44 in FIG. 2. The fine grid 68 has a plurality of apertures therethrough which are less than 26 microns in the smallest dimension. On the rear wall 20 are a plurality of electrodes 70 extending transversely across the channels 26.

The electron beam 52 in the second embodiment 60 is confined transversely in the guide by the conductive strips 64 of the grid 62. The beam 52 may be extracted by biasing either one of the electrodes 70*a* on the rear wall 20 or a wire 38*a* to repel the beam 52 toward the screen 28. A single continuous planar electrode on the rear wall 20 may be used as in the previous embodiment if one of the wires 38 is biased to extract the beam 52 from the guide. The beam passes between two adjacent strips 64 and through the fine grid 68 finally striking the screen 28.

In the second embodiment 60, the fine grid 68 prevents the high ultor electrical field from penetrating into the guide 32 and unbalancing the electrical fields therein. The grid strips 64 provide structural support for the grid 62 as well as confinement of the beam in the lateral dimension. Since the confinement is provided by the strips, the electrode or electrodes 70 on the rear wall 20 may be continuous.

Figure 6:
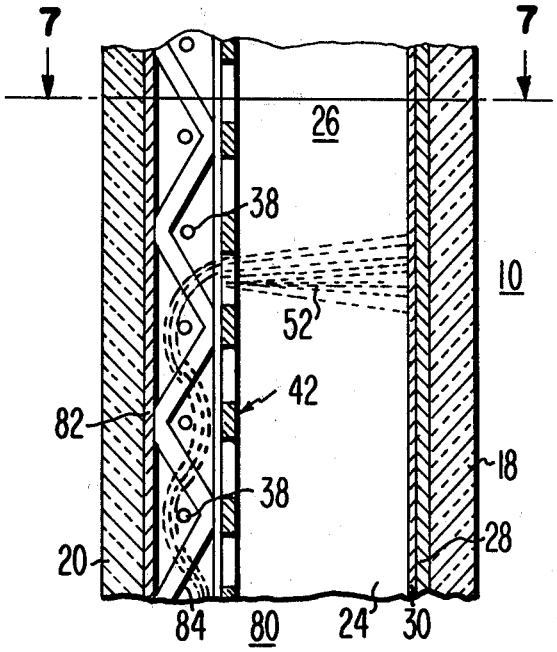
FIG. 6 is a sectional view similar to that of FIG. 2 of a modification of the beam guide of FIG. 2.
Figure 7:
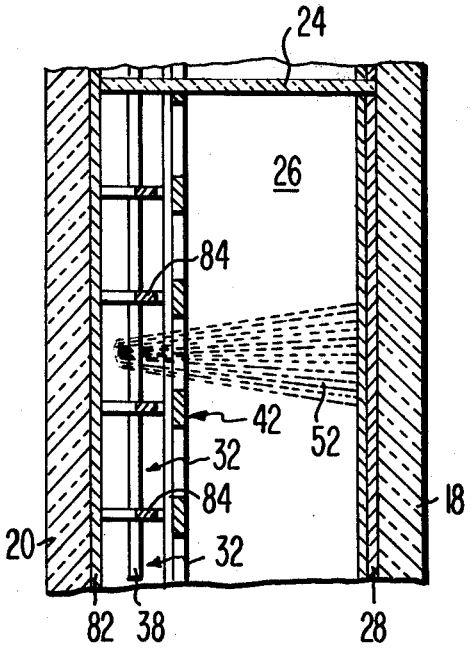
FIG. 7 is a sectional view taken along line 7—7 of FIG. 6.

With reference now to FIGS. 6 and 7, a third embodiment 80 of the electron beam guide 32 has a guide grid 42 identical to the guide 42 in the first embodiment 40. A single planar electrode 82 is on the rear wall 20. Alternatively, a plurality of transverse electrodes similar to the electrodes 70 in FIGS. 4 and 5 may be used. In this embodiment, lateral or transverse beam confinement is provided by a plurality of guide partitions 84 which extend between the electrode 82 and the grid 42. Each partition 84 is between adjacent guides 32 and zig-zag around the grid wires 38 contacting the electrode 82 and the guide grid 42. The partitions 84 are electrically insulated from the wires, and biased at the same potential as the electrode 82 and the grid 42. The bias produces forces which alternate along the direction of beam travel, and which prevent the beam 52 from spreading laterally in the guides.

I claim:

1. In a proximity focused display device having an envelope with a front wall and a rear wall spaced from each other, a cathodoluminescent screen on the front wall, a plurality of electron beam guides within the envelope parallel to the rear wall, and a source of an electron beam at one end of each beam guide; the improvement wherein the electron beam guides comprise:

at least one electrode adjacent and parallel to the rear wall; and an electrically conductive grid parallel to the electrode between the electrode and the front wall, the grid having a plurality of closely spaced apertures, the apertures being no greater than 26 microns in the smallest dimension.

2. The device as in claim 1, wherein the electrically conductive grid comprises:

a second grid mesh having a plurality of apertures therethrough, and a first grid mesh in contact with the second grid mesh and having a plurality of apertures therethrough, the apertures in the first grid mesh being no greater than 26 microns in the smallest dimension.

3. The device as in claim 2, wherein the apertures in the second mesh are of a size which will permit the electron beam from the source to pass through a single aperture.

4. The device as in claim 2, wherein the apertures in the first mesh are approximately 13 microns apart.

5. The device as in claim 2, wherein the plurality of electron beam guides further include grid wires and the device further comprises a plurality of electrically conductive partitions extending between the electrode and the grid, said partitions being electrically insulated from said grid wires.

6. The device as in claim 2 wherein the electrode comprises a layer of conductive material on the rear wall and a plurality of protrusions extending from the layer extending longitudinally along the beam guides.

7. The device as in claim 1 wherein the conductive grid comprises:

a plurality of electrically conductive strips extending longitudinally along the beam guides, a grid mesh in contact with the strips and having a plurality of apertures therethrough, the apertures being no greater than 26 microns in the smallest dimension.

8. The device as in claim 7 wherein there are a plurality of said electrodes extending transversely across each beam guide.

9. The device as in claim 1 further comprising a plurality of spaced parallel wires in a common plane between the electrode and the conductive grid.

* * * * *